US010589914B2

(12) United States Patent
Maruyama et al.

(10) Patent No.: US 10,589,914 B2
(45) Date of Patent: Mar. 17, 2020

(54) BLISTER SHEET AND BLISTER PACKAGING MACHINE

(71) Applicant: CKD Corporation, Aichi (JP)

(72) Inventors: Shunji Maruyama, Aichi (JP); Tsuyoshi Ohyama, Aichi (JP); Norihiko Sakaida, Aichi (JP)

(73) Assignee: CKD CORPORATION, Aichi (JP)

( * ) Notice: Subject to any disclaimer, the term of this patent is extended or adjusted under 35 U.S.C. 154(b) by 30 days.

(21) Appl. No.: 15/880,873

(22) Filed: Jan. 26, 2018

(65) Prior Publication Data

US 2018/0162618 A1 Jun. 14, 2018

Related U.S. Application Data

(63) Continuation of application No. PCT/JP2016/052870, filed on Feb. 1, 2016.

(30) Foreign Application Priority Data

Aug. 4, 2015 (JP) ..... 2015-154112

(51) Int. Cl.
*B65D 75/36* (2006.01)
*B65B 9/04* (2006.01)
*B65D 75/32* (2006.01)

(52) U.S. Cl.
CPC ..... *B65D 75/367* (2013.01); *B65B 9/04* (2013.01); *B65B 9/045* (2013.01); *B65D 75/327* (2013.01);

(Continued)

(58) Field of Classification Search
CPC .... B65D 75/367; B65D 75/327; B65D 75/36; B65D 75/32; B65D 83/04; B65D 83/0463;

(Continued)

(56) References Cited

U.S. PATENT DOCUMENTS 5,046,618 A * 9/1991 Wood ..... B65D 75/327 206/484
6,036,016 A 3/2000 Arnold (Continued)

FOREIGN PATENT DOCUMENTS

JP S47-22929 Y1 7/1972
JP 2001-315725 A 11/2001

(Continued)

OTHER PUBLICATIONS

International Search Report for corresponding International Application No. PCT/JP2016/052870, dated Apr. 19, 2016 (5 pages).

*Primary Examiner* — Steven A. Reynolds
(74) *Attorney, Agent, or Firm* — Osha Liang LLP

(57) ABSTRACT

A blister sheet includes a container film including pockets receiving a content, and a cover film mounted to the container film to close the pockets. The container and the cover film are made of synthetic resins. The cover film is thinner than the container film. One pair of cuts formed for each pocket passes through the container and the cover film and extends to the pocket such that each pocket is placed between the cuts. The container and the cover film are broken from the one pair of cuts toward the pocket. A cutting slit or perforation is formed in the container film to allow for separation of the blister sheet into sheet pieces. The cutting slit or perforation is extended to intersect with the cut and a portion of the cutting slit or perforation that intersects with the cut passes through the container and the cover film.

12 Claims, 9 Drawing Sheets

(52) U.S. Cl.
CPC .... *B65B 2230/02* (2013.01); *B65D 2575/362* (2013.01)

(58) Field of Classification Search
CPC . B65D 2575/362; B65D 83/0445; A61J 1/035
USPC ..... 206/532, 531, 534
See application file for complete search history.

(56) References Cited

U.S. PATENT DOCUMENTS 6,155,423 A * 12/2000 Katzner ..... B65D 75/327 206/469
6,352,158 B1 * 3/2002 Cole-Bennett ..... B65D 75/327 206/469
6,422,391 B1 7/2002 Swartz
7,395,928 B2 * 7/2008 Bertsch ..... B65D 75/327 206/528
7,607,834 B2 * 10/2009 Alvater ..... B65D 75/5805 206/532
7,866,474 B2 * 1/2011 Geser ..... B65D 75/327 206/532
9,682,012 B2 * 6/2017 Pattison ..... A61J 1/035
2002/0166790 A1 * 11/2002 Aylward ..... B65B 11/50 206/531
2004/0060845 A1 * 4/2004 Ito ..... A61J 1/035 206/530
2006/0131204 A1 * 6/2006 Geser ..... B65D 75/327 206/530
2007/0289893 A1 * 12/2007 Williams, Jr. ..... B65D 75/327 206/531

FOREIGN PATENT DOCUMENTS

JP 2004-502611 A 1/2004
JP 2004-155451 A 6/2004
JP 2005-170464 A 6/2005
JP 2008-531428 A 8/2008
JP 2010-254315 A 11/2010
JP 2011-213387 A 10/2011

* cited by examiner

BLISTER SHEET AND BLISTER PACKAGING MACHINE

BACKGROUND OF THE INVENTION

Technical Field

The present disclosure relates to a blister sheet in which tablets or capsules are packaged and a blister packing machine used to manufacture the blister sheet.

Background

A blister sheet is configured to include a container film with pockets that are formed to be filled with various contents, and a cover film mounted to the container film to seal openings of the pockets. For example, a material employed to form the cover film is relatively easily breakable aluminum foil. Pressing a pocket breaks the aluminum foil and enables its content (for example, a tablet or a capsule) to be taken out.

The blister sheet of this configuration enables the content to be taken out very easily and accordingly has excellent convenience. This blister sheet, on the other hand, enables even a small child or an elderly person to readily take out the content and is thus likely to cause accidental swallow of the content. One proposed technique provides a protective layer on the cover film with a view to providing a function that prevents the small child or the like from readily taking out the content (child resistance) (as described in, for example, Patent Literature 1).

CITATION LIST

Patent Literature

PTL 1: JP 2005-170464A

SUMMARY OF THE INVENTION

The above technique, however, requires an extra protective layer. This is likely to increase the material cost and complicate a manufacturing process and result in increasing various costs. Providing the extra protective layer is not preferable from the environmental point of view.

By taking into account the circumstances described above, one or more embodiments of the invention provide a blister sheet configured to have a child resistance and to more effectively prevent increases of various costs, and a blister packaging machine.

The following describes each of various aspects provided adequately to solve the problems described above. Functions and advantageous effects that are characteristic of each of the aspects are also described as appropriate.

Aspect 1. There is provided a blister sheet comprising a container film including a plurality of pockets configured to receive therein a content that is at least one of a tablet and a capsule; and a cover film mounted to the container film to close the pockets. The container film and the cover film are respectively made of synthetic resins. The cover film is made thinner than the container film. At least one pair of cuts is formed for each of the pockets and is provided to pass through the container film and the cover film and to be extended to before the pocket, such that each pocket is placed between the one pair of cuts. The container film and the cover film are broken from the one pair of cuts toward the pocket by applying a torsional stress from the one pair of cuts toward the pocket, and at least the cover film is broken at a position corresponding to the pocket, and the content is taken out from a portion of breakage of the cover film. A cutting slit or a cutting perforation is formed in at least the container film to allow for separation of the blister sheet into sheet pieces, each having a predetermined number of pockets. The cutting slit or the cutting perforation is extended to intersect with the cut. At least a portion of the cutting slit or the cutting perforation that intersects with the cut is configured to pass through the container film and the cover film.

In the above configuration of Aspect 1, the container film and the cover film are respectively made of synthetic resins and are not readily breakable. Even when a pocket is pressed, the cover film or the like is unlikely to be broken. This configuration thus effectively suppresses the content from breaking the cover film or the like and being ejected. The blister sheet is accordingly provided with child resistance.

The above configuration of Aspect 1 does not require providing a separate member (for example, protective layer). This configuration thus more effectively prevents increases of various costs and any adverse effect from the environmental point of view with a view to giving the child resistance.

Additionally, in the above configuration of Aspect 1, the container film and the cover film are broken from the cuts toward the pocket by applying the torsional stress from the pair of cuts toward the pocket. At least the relatively thin cover film out of the two films is broken at the position corresponding to the pocket. The content is then taken out from the portion of breakage of the cover film. This configuration does not require excessive time and effort to take out the content and thus ensures the sufficient convenience. In order to take out the content, on the other hand, it is required to additionally apply a torsional stress toward the pocket after grasping a portion of the blister sheet near to the cuts. This means that at least two actions are required to take out the content [A conventional blister sheet (PTP sheet) requires only one action of pressing a pocket to take out the content]. This configuration thus provides the better child resistance.

Additionally, when the blister sheet is separated along the cutting slit or the cutting perforation into the sheet pieces, a cut appears on an edge of each sheet piece. The content is taken out by additionally applying a torsional stress toward the pocket while grasping a portion of the sheet piece near to the cuts. An additional action of separating the blister sheet along the cutting slit or the cutting perforation is thus required to take out the content. In other words, at least one cut does not appear on the edge without such separation and is accordingly not broken by application of a torsional stress. This configuration requires a greater number of actions to take out the content and results in further improving the child resistance.

Furthermore, when the blister sheet is cut along the cutting slit or the cutting perforation to the cut, the cut is extended from a leading end of a cut portion in a direction intersecting with the cut portion. In this state, when a force is applied to the blister sheet to further advance separation of the blister sheet, the force is unlikely to be effectively applied to the cutting slit or the cutting perforation and is likely to be released toward the cut, due to the configuration of the cut that passes through both the films. This is likely to require time and labor for separation of the blister sheet and is likely to unintentionally cut the blister sheet by the released force.

In the above configuration of Aspect 1, on the other hand, at least the portion of the cutting slit or the cutting perforation that intersects with the cut is configured to pass through the container film and the cover film. When the blister sheet is cut along the cutting slit or the cutting perforation to the pass-through portion of the cutting slit or the cutting perforation, the pass-through portion intersects with the cut. In this state, when a force is applied to the blister sheet to further advance separation of the blister sheet, the force is more likely to be applied to (the pass-through portion of) the cutting slit or the cutting perforation and is unlikely to be released to the cut. This configuration facilitates separation of the blister sheet and further enhances the convenience.

This configuration also reduces the possibility that the blister sheet is unintentionally cut in the course of separation of the blister sheet. This securely prevents potential troubles caused by unintentional cutting of the blister sheet (for example, exposure of the content to the outside air or ejection of the content).

Aspect 2. In the blister sheet described in Aspect 1 above, multiple pairs of the cuts may be provided for each of the pockets.

In the above configuration of Aspect 2, multiple pairs of the cuts are provided for each pocket. This configuration allows a torsional force to be applied from any desired cut. This further enhances the convenience in the process of taking out the content.

Aspect 3. In the blister sheet described in either Aspect 1 or Aspect 2 above, the one pair of cuts may be arranged to be approximately aligned with each other.

The arrangement of "being approximately aligned with each other" is not limited to an arrangement that one pair of cuts is strictly aligned with each other but also includes an arrangement that the respective cuts are extended in one identical direction but are slightly shifted from each other along a direction perpendicular to the one identical direction.

The above configuration of Aspect 3 enables a torsional stress to be more readily applied from the cuts toward the pocket and further facilitates breakage of the container film and the cover film. This enables the content to be more readily taken out. This configuration also simplifies a mechanism provided to form the cuts and thereby more effectively suppresses an increase of the cost.

Aspect 4. In the blister sheet described in any of Aspects 1 to 3 above, information regarding a method of taking out the content by applying the torsional stress from the cuts toward the pocket may be displayed.

In the above configuration of Aspect 4, the information indicating that the content is taken out by applying a torsional stress from the cut toward the pocket is displayed in the blister sheet. This configuration allows a new user of the blister sheet to check the information and readily understand the correct method of taking out the content. This furthermore enhances the convenience. This also more effectively prevents potential troubles (for example, damage of the content) due to an inappropriate method of taking out the content (for example, pressing the pocket).

Aspect 5. There is provided a blister packaging machine configured to fill a content that is at least one of a tablet and a capsule in each of pockets formed in a strip of a container film that is made of a synthetic resin, subsequently form a strip of a blister sheet by mounting a strip of a cover film that is thinner than the strip of the container film and that is made of a synthetic resin, to the container film to close the pockets, and produce a blister sheet by punching the blister film in a sheet unit. The blister packaging machine comprises a pocket forming device configured to form the pockets in the container film; a filling device configured to fill the content in the pockets; a mounting device configured to mount the cover film to the container film with the content filled in the pockets, such as to close the pockets; a punching device configured to punch the blister film obtained by mounting the cover film to the container film, in the sheet unit; a cut forming device configured to form at least one pair of cuts for each of the pockets in the blister film, wherein the one pair of cuts is provided to pass through the container film and the cover film and to be extended to before the pocket, such that each pocket is placed between the one pair of cuts; and a separation forming device configured to form a cutting slit or a cutting perforation in at least the container film, wherein the cutting slit or the cutting perforation is extended in a direction perpendicular to the cut and is used to separate the blister sheet into sheet pieces, each having a predetermined number of pockets. The separation forming device forms the cutting slit or the cutting perforation, such that at least a portion of the cutting slit or the cutting perforation that intersects with the cut passes through the container film and the cover film.

The above configuration of Aspect 5 manufactures a blister sheet having the functions and the advantageous effects according to Aspect 1 above.

Aspect 6. In the blister packaging device described in Aspect 5, the cut forming device may be integrated with the separation forming device.

The above configuration of Aspect 6 has the cut forming device and the separation forming device that are integrated with each other and thereby achieves downsizing of the machine.

DETAILED DESCRIPTION

Figure 1:
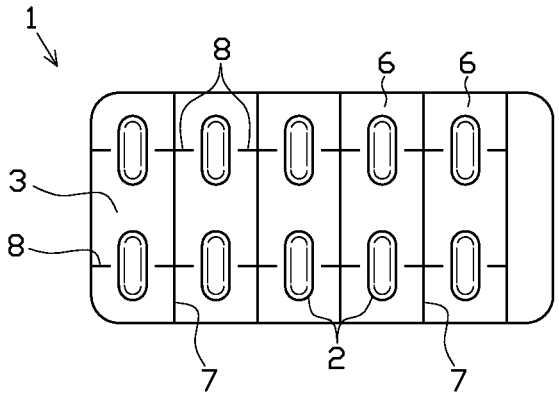
FIG. 1 is a plan view illustrating a blister sheet according to one or more embodiments of the invention.
Figure 2:
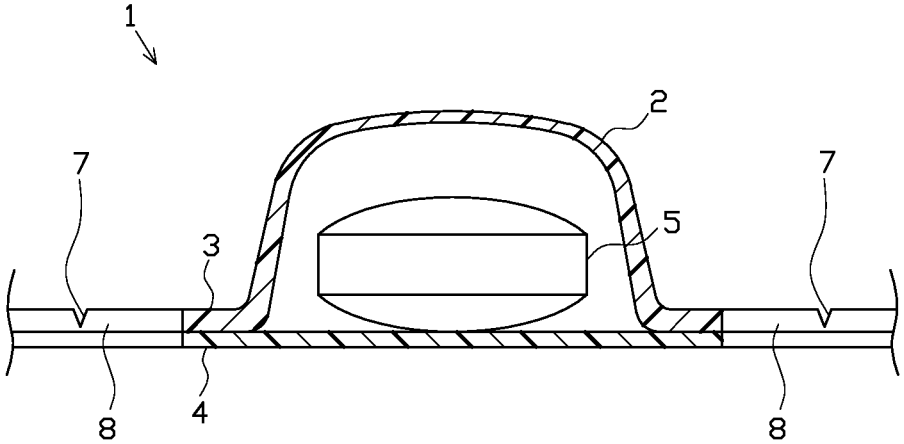
FIG. 2 is an enlarged sectional view illustrating the blister sheet according to one or more embodiments of the invention.

The following describes one embodiment with reference to drawings. The configuration of a blister sheet is described first in detail. As shown in FIG. 1 and FIG. 2, a blister sheet 1 includes a container film 3 with a plurality of pockets 2 and a cover film 4 mounted to the container film 3 to close the pockets 2. Each of the pockets 2 has one tablet 5 as the content placed therein. The blister sheet 1 according one or more embodiments of the invention has two pocket lines, each being formed to include five pockets 2.

The container film 3 is made of a predetermined synthetic resin [for example, a thermoplastic resin material such as PP (polypropylene) or PVC (polyvinyl chloride)].

The cover film 4 is made of a predetermined synthetic resin (for example, PP or the like is used when the container film 3 is made of PP, and a polyamide-based synthetic resin is used when the container film 3 is made of PVC).

The container film 3 has a plurality of cutting slits 7 that are formed to separate the blister sheet 1 into pair pieces 6 (corresponding to sheet pieces), each including two pockets 2. According to one or more embodiments of the invention, the cutting slits 7 are formed in a groove-like shape extended in a direction parallel to a short side direction of the blister sheet 1.

The blister sheet 1 additionally has cuts 8 that are formed to pass through the container film 3 and the cover film 4. The cuts 8 are extended along a direction perpendicular to the cutting slits 7 to before (immediately before) the pockets 2. The cuts 8 are formed to intersect with the cutting slits 7 or to pass through an edge of the blister sheet 1. When the blister sheet 1 is separated into the pair pieces 6, the cuts 8 are extended from respective edges of each pair piece 6 to before (immediately before) each pocket 2 (for example, to positions within 10 mm from each pocket 2) in the approximate center in a longitudinal direction of each pocket 2. In other words, at least one pair of the cuts 8 are formed for each of the pockets 2, such that each pocket 2 is placed between the one pair of cuts 8. The one pair of cuts 8 are formed to be aligned with each other. A tag portion 8 with stamped identification information such as a lot number is provided in an edge of the blister sheet 1.

Figure 3:
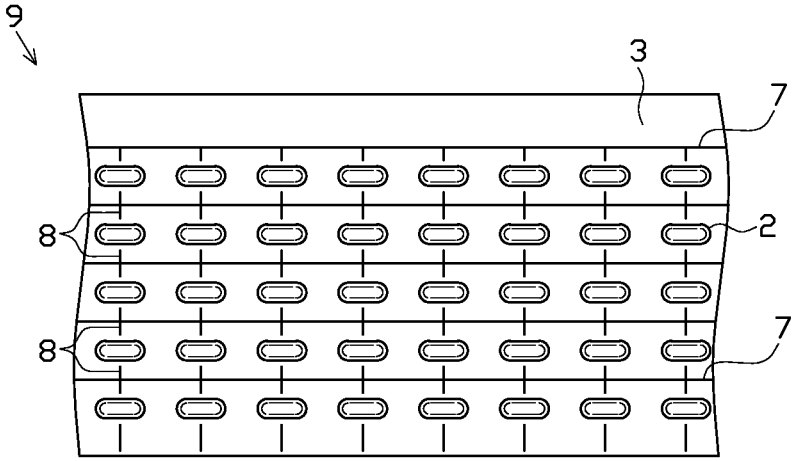
FIG. 3 is a plan view illustrating a blister film according to one or more embodiments of the invention.

The blister sheet 1 is manufactured by punching out a strip of blister film 9 (shown in FIG. 3) that is formed from a strip of the container film 3 and a strip of the cover film 4, into a sheet form.

Figure 4:
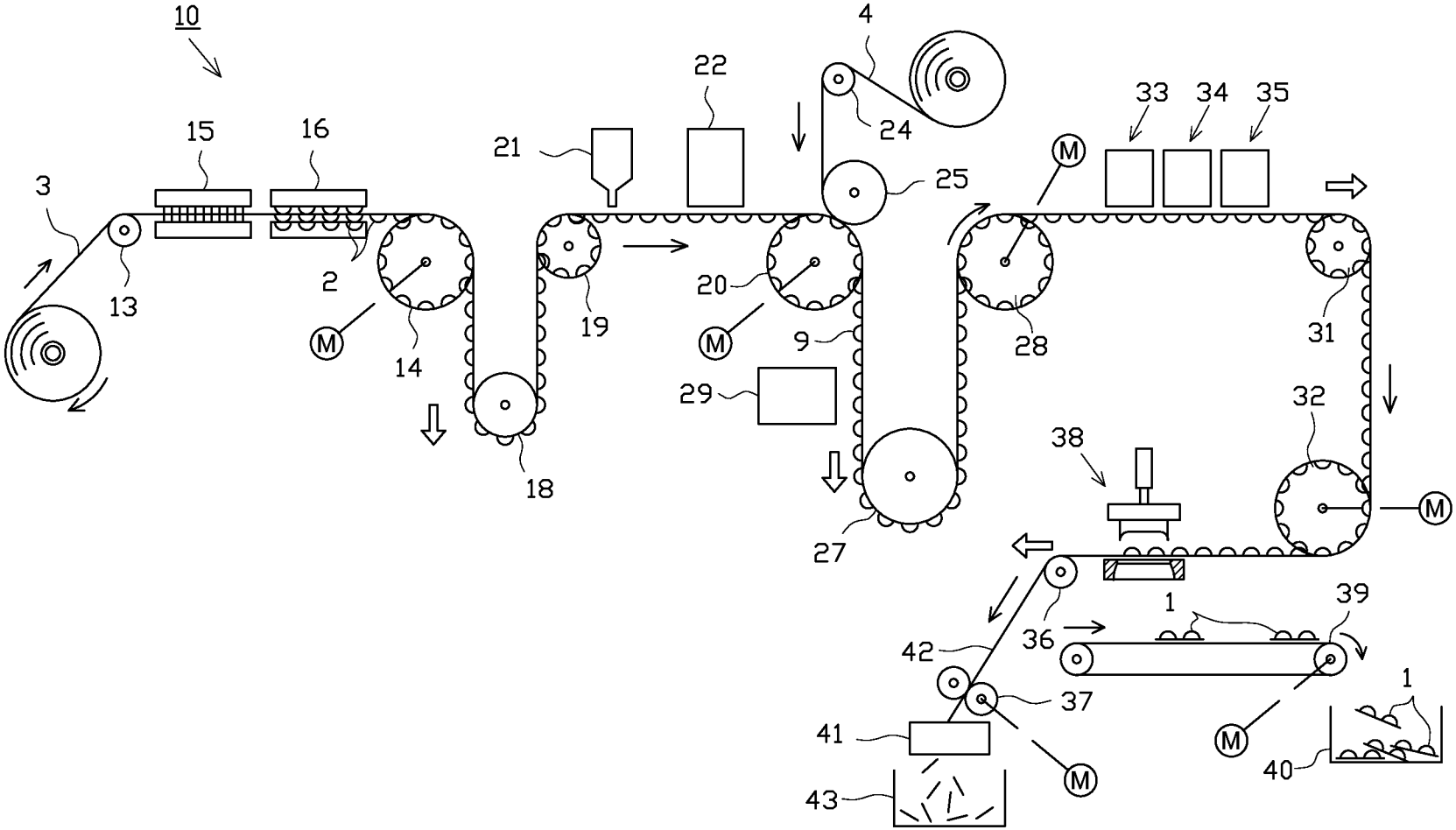
FIG. 4 is a diagram illustrating the schematic configuration of a blister packaging machine according to one or more embodiments of the invention.

The following describes the schematic configuration of a blister packaging machine 10 used to manufacture the above blister sheet 1 with reference to FIG. 4.

As shown in FIG. 4, the strip of the container film 3 is wound in a roll on an uppermost stream side of the blister packaging machine 10. A pullout end of the container film 3 wound in the roll is guided by a guide roll 13. The container film 3 is wound around an intermittent feed roll 14 on a downstream side of the guide roll 13. The intermittent feed roll 14 is coupled with a motor that intermittently rotates, to convey the container film 3 intermittently.

A heating device 15 and a pocket forming device 16 are sequentially placed between the guide roll 13 and the intermittent feed roll 14 along a conveyance path of the container film 3. In the state that the container film 3 is heated to be relatively soft by the heating device 15, a plurality of the pockets 2 are formed at predetermined positions of the container film 3 by the pocket forming device 16. The pockets 2 are formed during an interval between conveyance operations of the container film 3 by the intermittent feed roll 14. According to one or more embodiments of the invention, the heating device 15 and the pocket forming device 16 correspond to the pocket forming device.

The container film 3 fed out from the intermittent feed roll 14 is then wound around a tension roll 18, a guide roll 19 and a film-receiving roll 20 in this sequence. The film-receiving roll 20 is coupled with a motor that rotates at a fixed speed, to continuously convey the container film 3 at a fixed speed. The tension roll 18 pulls the container film 3 to be tensed by the elastic force and serves to prevent a slack of the container film 3 due to a difference between the conveyance operations of the intermittent feed roll 14 and the film-receiving roll 20 and keep the container film 3 in a continuously tensed state.

A tablet filling device 21 is placed between the guide roll 19 and the film-receiving roll 20 along the conveyance path of the container film 3. The tablet filling device 21 serves as a filling device to automatically fill the tablets 5 in the respective pockets 2. The tablet filling device 21 opens a shutter to drop off the tablet 5 at predetermined time intervals, synchronously with the conveyance operation of the container film 3 by the film-receiving roll 20, and thereby causes the tablets 5 to be filled in the respective pockets 2 accompanied with this shutter-opening operation.

An inspection device 22 is placed between the tablet filling device 21 and the film-receiving roll 20 along the conveyance path of the container film 3. This inspection device 22 mainly performs inspection with regard to a tablet defect, for example, whether a tablet 5 is certainly filled in each pocket 2, the presence or the absence of any abnormality of the tablet 5, or inclusion or no inclusion of any extraneous substance in the pocket 2.

The strip of the cover film 4 is, on the other hand, wound in a roll on an uppermost stream side.

A pullout end of the cover film 4 wound in the roll is guided to a heating roll 25 by a guide roll 24. The heating roll 25 is arranged to be pressed against the film-receiving roll 20, and the container film 3 and the cover film 4 are fed between the two rolls 20 and 25. The container film 3 and the cover film 4 pass through between the two rolls 20 and 25 in a heated and pressed state, so that the cover film 4 is fused to the container film 3 to close the respective pockets 2. This produces the strip of the blister film 9 with the tablets 5 filled in the respective pockets 2.

The blister film 9 fed out from the film-receiving roll 20 is then wound around a tension roll 27 and an intermittent feed roll 28 in this sequence.

The intermittent feed roll 28 is coupled with a motor that intermittently rotates, to convey the blister film 9 intermittently. The tension roll 27 pulls the blister film 9 to be tensed by the elastic force and serves to prevent a slack of the blister film 9 due to a difference between the conveyance operations of the film-receiving roll 20 and the intermittent feed roll 28 and keep the blister film 9 in a continuously tensed state.

An inspection device 29 is placed between the film-receiving roll 20 and the tension roll 27 along a conveyance path of the blister film 9. This inspection device 29 mainly performs inspection with regard to damage, such as cracking or breaking, of the cover film 4.

The blister film 9 fed out from the intermittent feed roll 28 is then wound around a tension roll 31 and an intermittent feed roll 32 in this sequence.

The intermittent feed roll 32 is coupled with a motor that intermittently rotates, to convey the blister film 9 intermittently. The tension roll 31 pulls the blister film 9 to be tensed by the elastic force and serves to prevent a slack of the blister film 9 between the intermittent feed rolls 28 and 32.

A slit forming device 33, a cut forming device 34 and a stamping device 35 are sequentially placed between the intermittent feed roll 28 and the tension roll 31 along the conveyance path of the blister film 9. The slit forming device 33 is configured as a separation forming device and serves to form the cutting slits 7 at predetermined positions of the blister film 9. The cut forming device 34 is configured as a cut forming device and serves to form the cuts 8 at predetermined positions of the blister sheet 9. The stamping device 35 serves to provide a stamp at a predetermined position (for example, the tag portion described above) of the blister sheet 9.

The blister film 9 fed out from the intermittent feed roll 32 is then wound on its downstream side around a tension roll 36 and a continuous feed roll 37 in this sequence. A sheet punching device 38 as a punching device is placed between the intermittent feed roll 32 and the tension roll 36 along the conveyance path of the blister film 9. The sheet punching device 38 serves to punch out the outer edge of each blister sheet 1 from the blister film 9.

The blister sheet 1 punched out by the sheet punching device 38 is conveyed by a take-out conveyor 39 and is once stored in a completed product hopper 40. The blister sheet 1 determined as a defective product by the inspection device 22 or the inspection device 29 described above is separately discharged by a non-illustrated defective sheet discharge mechanism.

A cutting device 41 is placed on a downstream side of the continuous feed roll 37. A strip of a scrap portion 42 remaining after the punch-out by the sheet punching device 38 is guided by the tension roll 36 and the continuous feed roll 37 and is introduced to the cutting device 41. A driven roll is arranged to be pressed against the continuous feed roll 37, so that the scrap portion 42 is placed and conveyed therebetween. The cutting device 41 serves to cut the scrap portion 42 into a predetermined size as scrap pieces. The scrap pieces cut into from the scrap portion 42 are stored in a scrap holler 43 and are separately discarded.

The respective surfaces of, for example, the rolls 14, 19, 20, 28, 31 and 32 described above are arranged to be opposed to the pockets 2. The respective rolls 14 and the like, however, have recesses on their surfaces to receive the pockets 2 therein. This configuration prevents the pockets 2 from being crushed. The configuration that places the pockets 2 in the recesses of the respective rolls 14 and the like during a feeding operation ensures a reliable intermittent feed operation and a reliable continuous feed operation.

The schematic configuration of the blister packing machine 1 is described above. The following describes the configurations of the slit forming device 33 and the cut forming device 34 more concretely. A common mechanism of the slit forming device 33 and the cut forming device 34 is described first.

Figure 5:
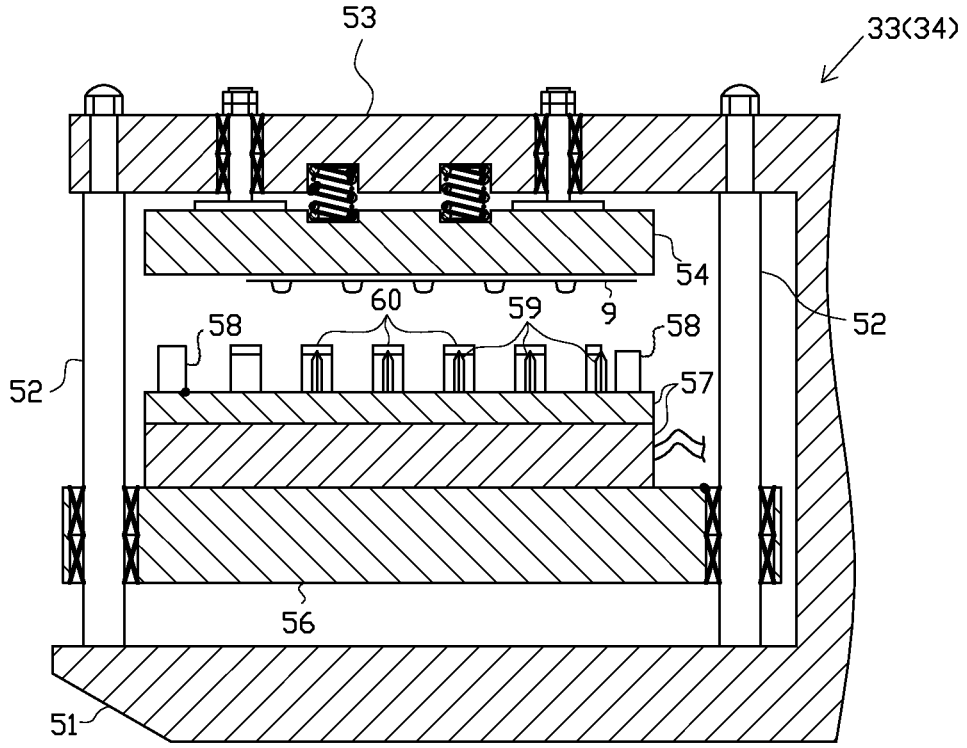
FIG. 5 is a sectional diagram illustrating the configuration of a slit forming device and the like according to one or more embodiments of the invention.
Figure 8:
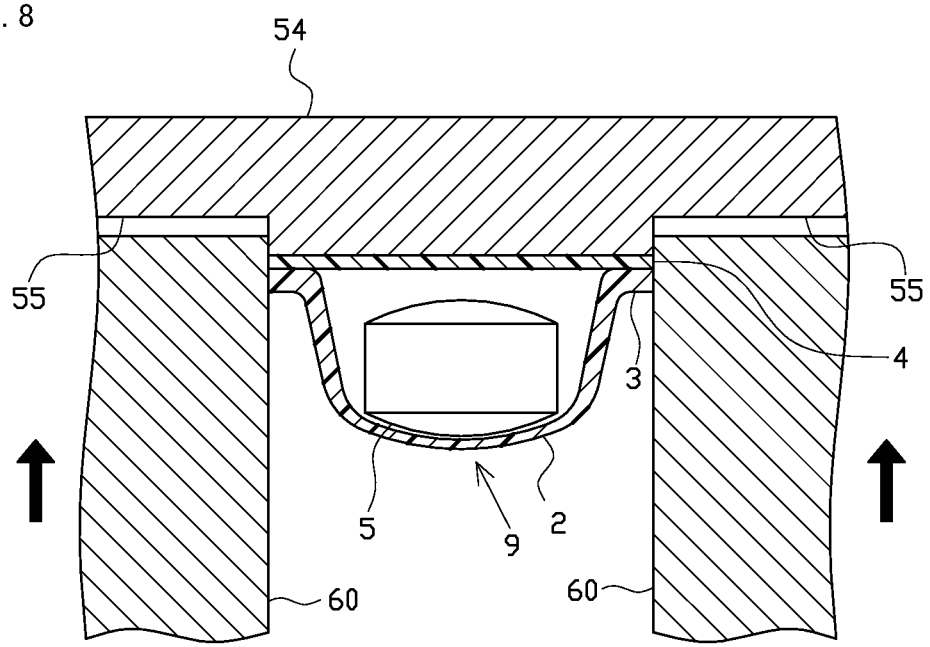
FIG. 8 is a sectional diagram illustrating cut forming blades, the container film and the like in the process of forming cuts according to one or more embodiments of the invention.

As shown in FIG. 5, each of the slit forming device 33 and the cut forming device 34 includes a base 51, a pair of masts 52 placed to stand on the base 51, and a fixation plate 53 fixed on upper portions of the masts 52. A receiving plate 54 is supported on the fixation plate 53 to be suspended therefrom. The receiving plate 54 of the slit forming device 33 has a flat lower end surface, while the receiving plate 54 of the cut forming device 34 has a plurality of recessed holes 55 on its lower end surface (as shown in FIG. 8). A cooling water passage (not shown) is formed as a cooling mechanism in each receiving plate 54 to continuously keep the receiving plate 54 cooled by cooling water that is circulated through the cooling water passage.

The masts 52 are inserted through bearing mechanisms of a slide base 56. The slide base 56 is configured to be vertically movable by a non-illustrated driving device. A heater block 57 equipped with a heating mechanism is placed and fixed on an upper face of the slide base 56. The blister film 9 is intermittently fed between the heater block 57 and the receiving plate 54. Stoppers 58 are fixed to stand on respective edges of the heater block 57.

The following describes different configurations of the slit forming device 33 and the cut forming device 34.

Figure 6:
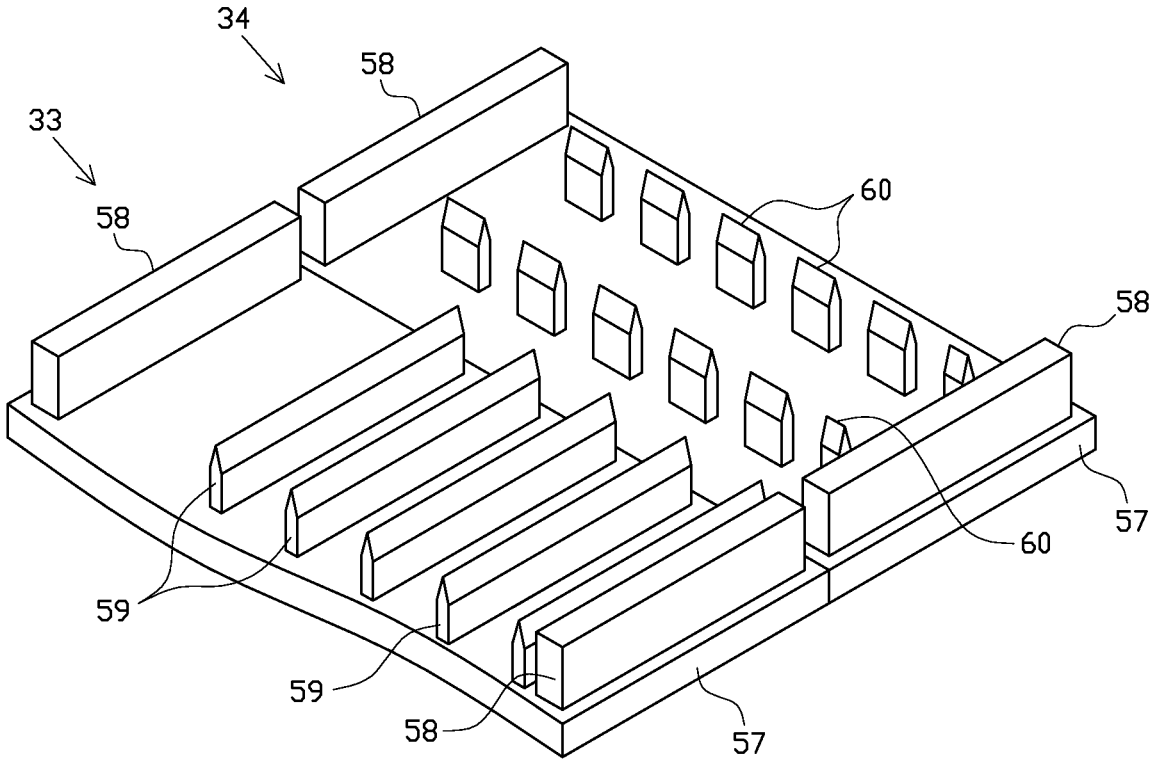
FIG. 6 is a perspective diagram illustrating the configuration of the slit forming device and the like according to one or more embodiments of the invention.

In the slit forming device 33, as shown in FIG. 6, a plurality of slit forming blades 59 are provided on an upper face of the heater block 57. The respective slit forming blades 59 are extended along a conveying direction of the blister film 9 and are arranged at equal intervals along a direction perpendicular to the conveying direction. The slit forming blades 59 are usually kept in the heated state by heat transmitted from the heater block 57. Additionally, the slit forming blades 59 are protruded slightly from upper faces of the stoppers 58. The amount of this protrusion is smaller than the thickness of the container film 3.

In the cut forming device 34, on the other hand, a plurality of cut forming blades 60 are provided on an upper face of the heater block 57. The respective cut forming blades 60 are extended along the direction perpendicular to the conveying direction of the blister film 9 and are arranged at equal intervals along the perpendicular direction. The cut forming blades 60 are usually kept in the heated state by heat transmitted from the heater block 57. Additionally, the cut forming blades 60 are protruded from upper faces of the stoppers 58. The amount of this protrusion is sufficiently larger than the thicknesses of the container film 3 and the cover film 4. The holes 55 of the receiving plate 54 described above are formed at positions opposed to the respective cut forming blades 60.

The following mainly describes principal processes after insertion of the tablets 5 into the pockets 2 and formation of the blister film 9 in the manufacturing process of the blister sheet 1 by the blister packaging machine 10 described above.

Figure 7:
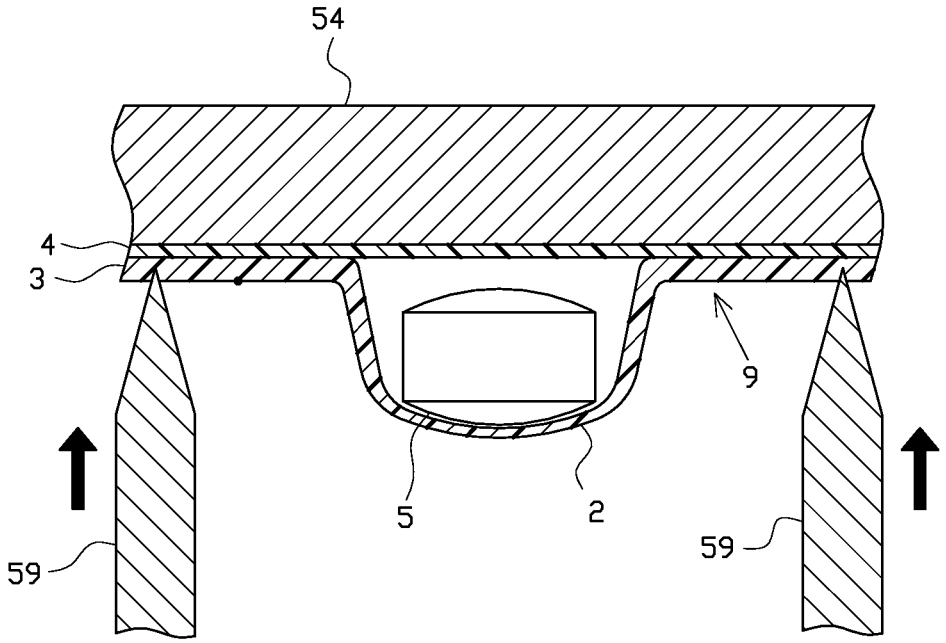
FIG. 7 is a sectional diagram illustrating slit forming blades, a container film and the like in the process of forming cutting slits according to one or more embodiments of the invention.

The formed blister sheet 9 first goes through a slit forming process. The slit forming device 33 described above is used in the slit forming process. In this process, when the blister film 9 that is intermittently fed is stopped at a predetermined position, the slide base 56 is moved up along the masts 52. The stoppers 58 come into contact with the receiving plate 54, so as to restrict any further upward motion of the slide base 56. In this state, the blister film 9 is placed between the slit forming blades 59 and the receiving plate 54 as shown in FIG. 7. The leading ends of the slit forming blades 59 enter portions of the container film 3 between respective adjacent pockets 2 to cut the container film 3 by a predetermined amount. This forms the cutting slits 7 in the container film 3. After formation of the cutting slits 7, the slide base 56 is moved back to its original position.

The blister film 9 with the cutting slits 7 formed therein subsequently goes through a cut forming process. The cut forming device 34 described above is used in the cut forming process. As in the slit forming process described above, in this process, when the blister film 9 that is intermittently fed is stopped at a predetermined position, the slide base 56 is moved up until the stoppers 58 come into contact with the receiving plate 54. As shown in FIG. 8, the leading ends of the cut forming blades 60 pass through portions of the blister film 9 between respective adjacent pockets 2 and enter the holes 55. As a result, the cuts 8 that pass through both the films 3 and 4 are formed in the portions of the blister film 9 that intersect with the cutting slits 7. After formation of the cuts 8, the slide base 56 is moved back to its original position. According to one or more embodiments of the invention, the slide bases 56 of the respective devices 33 and 34 are moved at the same time to simultaneously form the cutting slits 7 in one blister sheet 1 and the cuts 8 in an adjacent blister sheet 1.

The slit forming blades 59 and the cut forming blades 60 are heated by the heat transmitted from the heater block 57. This accelerates smooth cutting by the slit forming blades 59 and the cut forming blades 60 and ensures formation of the cutting slits 7 and the cuts 8 with the higher accuracy. The receiving plate 54 is cooled down by the cooling water. This configuration suppresses the heat from being transferred from the slit forming blades 59 and the cut forming blades 60 to the entire container film 3 and the entire cover film 4. Accordingly, this prevents breakage and fusion of the container film 3 and the cover film 4 that are respectively made of resins.

A stamping process is performed after termination of the slit forming process and the cut forming process. The stamping device 35 is used in the stamping process. In this stamping process, a movable mold of the stamping device 35 is moved from a predetermined standby position to a predetermined working position, so as to stamp identification information such as a lot number at a position of the blister film 9 corresponding to the tag portion described above.

A sheet punching process is performed after termination of the stamping process. The sheet punching device 38 is used in the sheet punching process. In this sheet punching process, a movable mold of the sheet punching device 38 is moved from a predetermined standby position to a working position, so as to punch the blister film 9 in a sheet unit. This results in producing the blister sheet 1.

The following describes the handling in use of the blister sheet 1 produced as described above.

Figure 9:
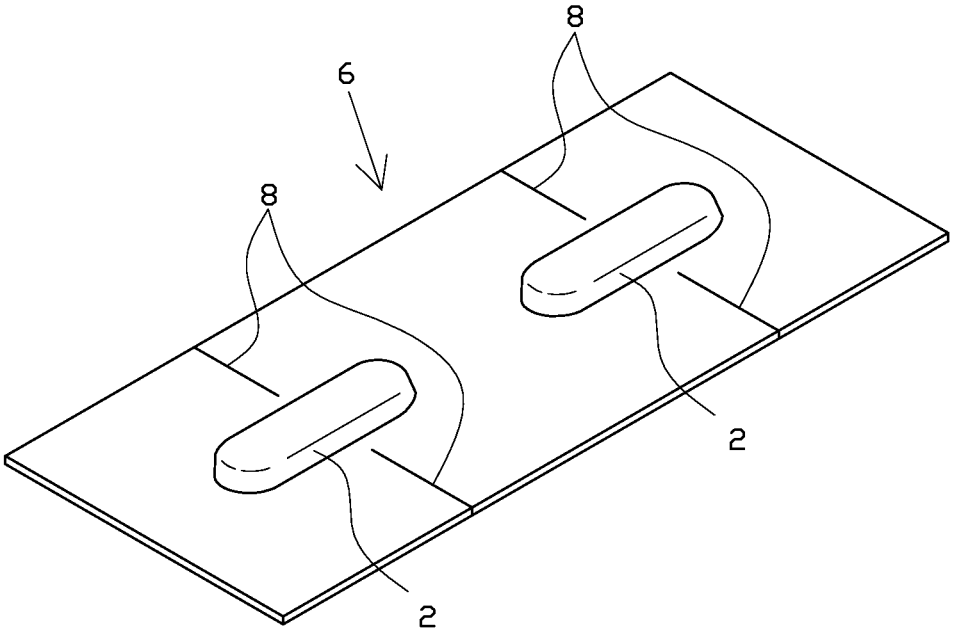
FIG. 9 is a perspective view illustrating separation into a pair piece according to one or more embodiments of the invention.

In use, the blister sheet 1 is first separated by the cutting slits 7 into the pair pieces 6, each having a predetermined number of (two according to one or more embodiments of the invention) pockets 2, as shown in FIG. 9. Each pair piece 6 has the cuts 8 that are extended from the respective edges of the pair piece 6 toward the pockets 2.

Figure 10:
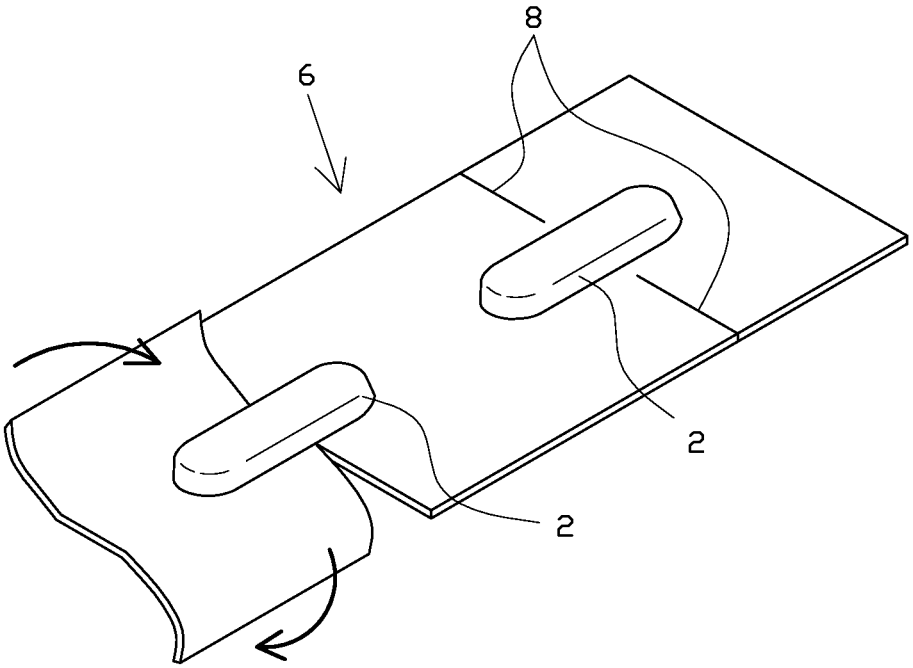
FIG. 10 is a perspective view illustrating the pair piece to describe a method of taking out a tablet according to one or more embodiments of the invention.
Figure 11:
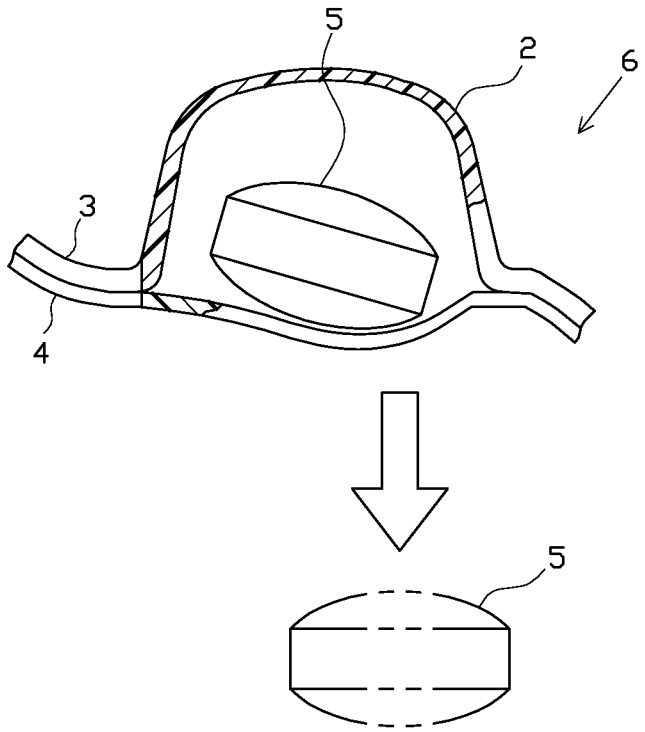
FIG. 11 is a sectional diagram illustrating the pair piece to describe the method of taking out the tablet according to one or more embodiments of the invention.

An operator (user) subsequently applies a torsional stress while grasping a portion of the pair piece 6 near to the cuts 8 in the operator's (user's) hand. The container film 3 and the cover film 4 are then broken from the respective leading ends of the cuts 8 toward the pocket 2 as shown in FIG. 10. Further application of the torsional stress causes the container film 3 and the cover film 4 (or at least the cover film 4) to be broken at a position corresponding to the pocket 2 as shown in FIG. 11. As a result, the tablet 5 is easily taken out from the pocket 2.

As described above, according to one or more embodiments of the invention, the container film 3 and the cover film 4 are respectively made of synthetic resins and are not readily breakable. Even when a pocket 2 is pressed, the cover film 4 or the like is unlikely to be broken. This configuration thus effectively suppresses the tablet 5 from breaking the cover film 4 or the like and being ejected. The blister sheet 1 is accordingly provided with child resistance.

This configuration does not require to provide any separate member (for example, protective layer) to give the child resistance. This configuration thus more effectively prevents increases of various costs and any adverse effect from the environmental point of view.

Additionally, the configuration of the above embodiment does not require excessive time and effort to take out the tablet 5 and thus ensures the sufficient convenience. In order to take out the tablet 5, on the other hand, it is required to additionally apply a torsional stress toward the pocket 2 after grasping a portion of the blister sheet 1 near to the cuts 8. This means that at least two actions are required to take out the tablet 5. This configuration thus provides the better child resistance.

Furthermore, the configuration in one or more embodiments of the invention requires an additional action of separating the blister sheet 1 along the cutting slit 7, in order to take out the tablet 5. In other words, at least one cut 8 does not appear on the edge without such separation and is accordingly not broken by application of a torsional stress. This configuration requires a greater number of actions to take out the tablet 5 and results in further improving the child resistance.

The one pair of cuts 8 are provided to be approximately aligned with each other. This configuration causes a torsional stress to be more readily applied from the cuts 8 toward the pocket 2 and thereby causes both the films 3 and 4 to be more readily broken. This accordingly causes the tablet 5 to be more readily taken out. In the cut forming device 34, the cut forming blades 60 are arranged to be approximately aligned with one another. This simplifies the configuration of the cut forming device 34 and more effectively suppresses an increase in cost.

The present disclosure is not limited to the description of the above embodiment but may be implemented, for example, by configurations described below. The present disclosure may also be naturally implemented by applications and modifications other than those illustrated below.

(a) According to the above embodiment, the one pair of cuts 8 are configured to be extended from the respective edges of each pair piece 6 toward the pocket 2 and to be aligned with each other. The configuration of the cut is, however, not limited to the above embodiment but may be any configuration that allows the cover film 4 and the like to be broken by application of a torsional stress toward the pocket 2.

Figure 12:
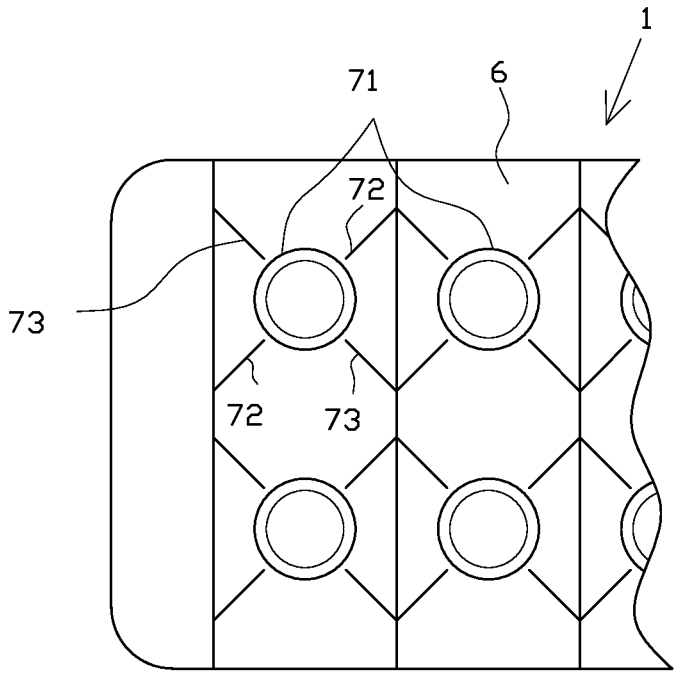
FIG. 12 is a partly enlarged plan view illustrating the configuration of cuts according to one or more embodiments of the invention.

Accordingly, for example, as shown in FIG. 12, in the case of pockets 71 in a planar circular shape, multiple pairs of cuts 73 and 73 may be formed for each pocket 71. In this configuration, a torsional stress may be applied from the operator's desired cut 72 or 73. As a result, this improves the handling properties.

Figure 13:
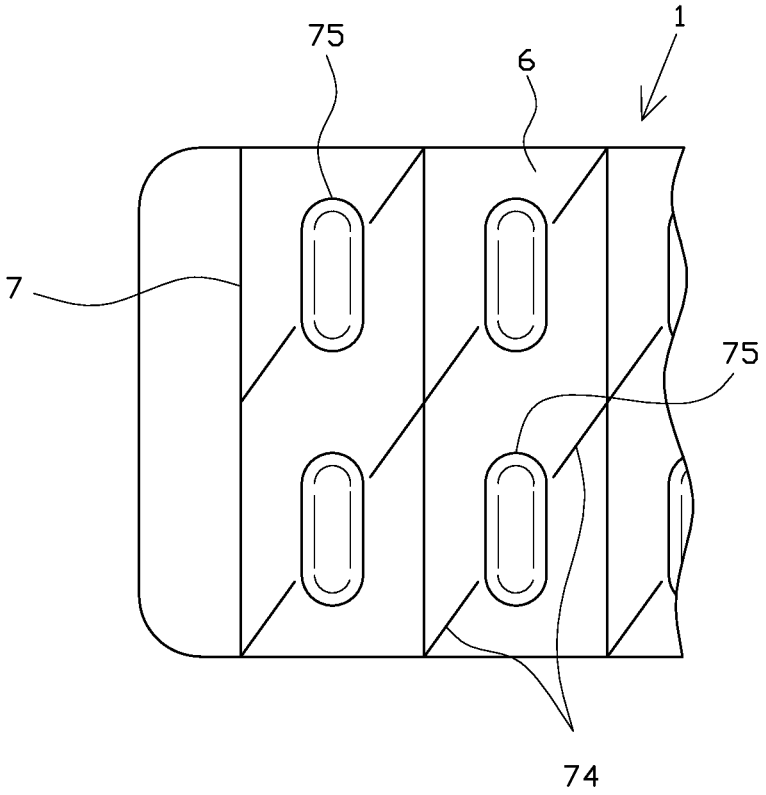
FIG. 13 is a partly enlarged plan view illustrating the configuration of cuts according to one or more embodiments of the invention.

In another example, as shown in FIG. 13, cuts 74 may be formed to be obliquely extended from corners of each pair piece 6 or their peripheries, such that their extended line goes through the approximate center in a longitudinal direction of each pocket 75. This configuration basically has similar functions and advantageous effects to those of the above embodiment.

Figure 14:
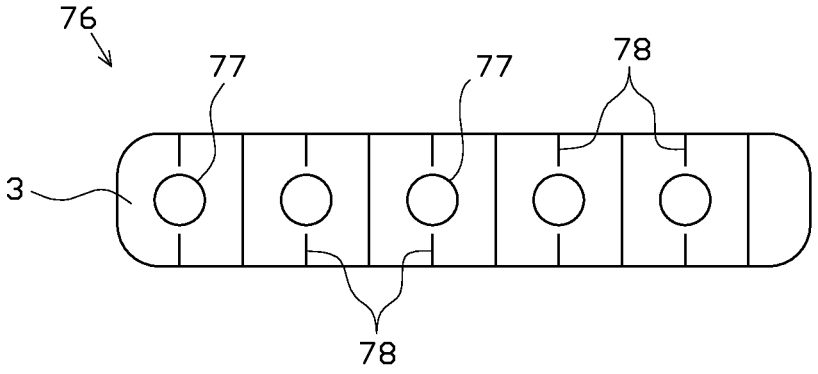
FIG. 14 is a plan view illustrating a blister sheet according to one or more embodiments of the invention.

(b) According to the above embodiment, the blister sheet 1 is configured to have two pocket lines, each consisting of five pockets 2. The array of pockets in the blister sheet is, however, not specifically limited. For example, as shown in FIG. 14, a blister sheet 76 may have one pocket line consisting of a predetermined number of pockets 77. In this modification, cuts 78 are extended from respective edges of the blister sheet 76 to before respective pockets 77, such that each pocket 77 is placed between the cuts 78. Accordingly, cuts may be configured to be extended from edges of each sheet of the container film 3 and the cover film 4 toward respective pockets at least in use (to take out the tablet 5).

Figure 15:
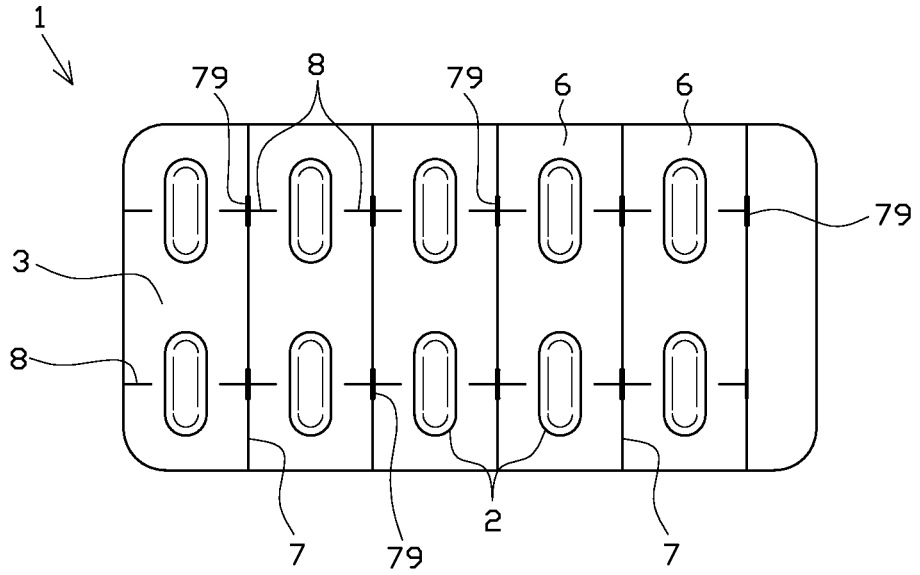
FIG. 15 is a plan view illustrating a blister sheet with intersecting cuts according to one or more embodiments of the invention.

(c) According to the above embodiment, the cutting slit 7 is formed as a groove and is configured not to pass through the container film 3 and the cover film 4. As shown in FIG. 15, portions of the cutting slits 7 that intersect with the cuts 8 may be formed as intersect cuts 79 (portions shown by thick lines in FIG. 15) that pass through both the films 3 and 4. In this modification, when the blister sheet 1 is cut along the cutting slit 7 to the intersect cut 79, the intersect cut 79 intersects with the cut 8. In this state, when a force is applied to the blister sheet 1 to further advance separation of the blister sheet 1, the force is more likely to be applied to the cutting slit 7 (intersect cut 79) and is unlikely to be released to the cut 8. This configuration facilitates separation of the blister sheet 1 and further enhances the convenience.

This configuration also reduces the possibility that the blister sheet 1 is unintentionally cut in the course of separation of the blister sheet 1. This securely prevents potential troubles caused by unintentional cutting of the blister sheet 1 (for example, exposure of the tablet 5 to the outside air or ejection of the tablet 5).

Figure 16:
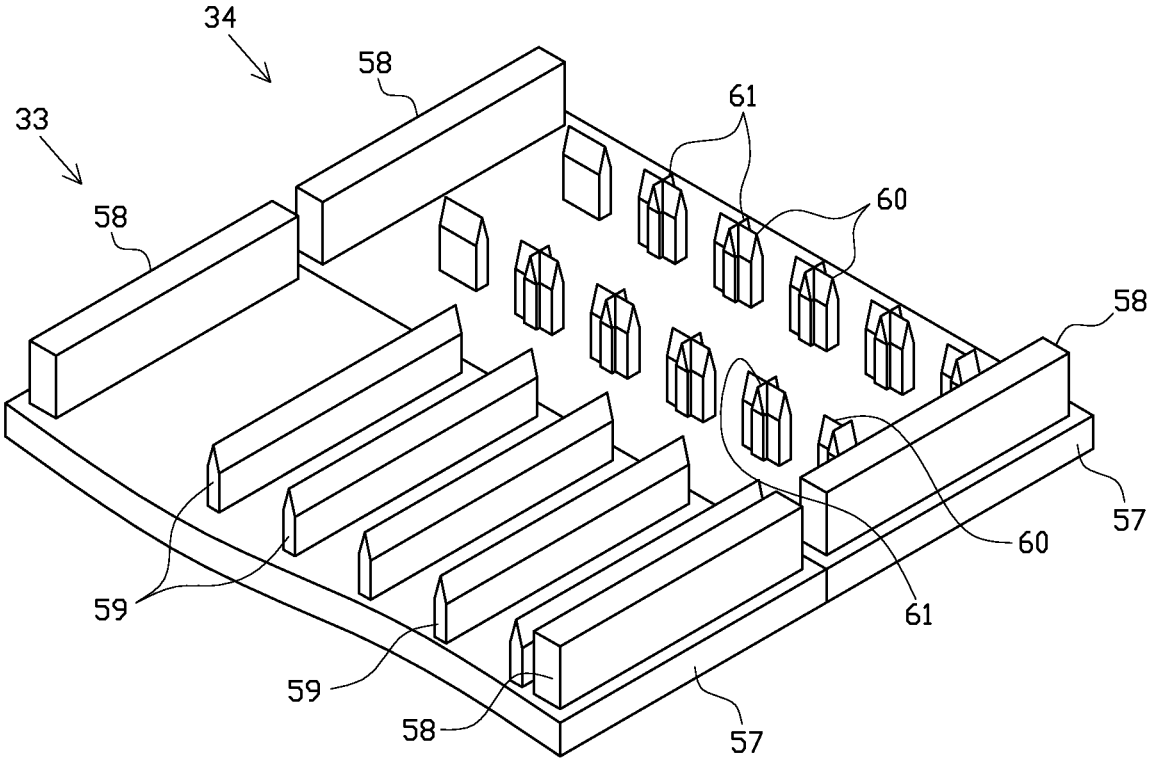
FIG. 16 is a perspective diagram illustrating a cut forming device according to one or more embodiments of the invention.

For example, as shown in FIG. 16, the intersect cuts 79 may be formed simultaneously with the cuts by providing intersect blades 61 that are arranged to intersect with the cut forming blades 60 and to be extended in the same direction as that of the slit forming blades 59, in the cut forming device 34.

Figure 17:
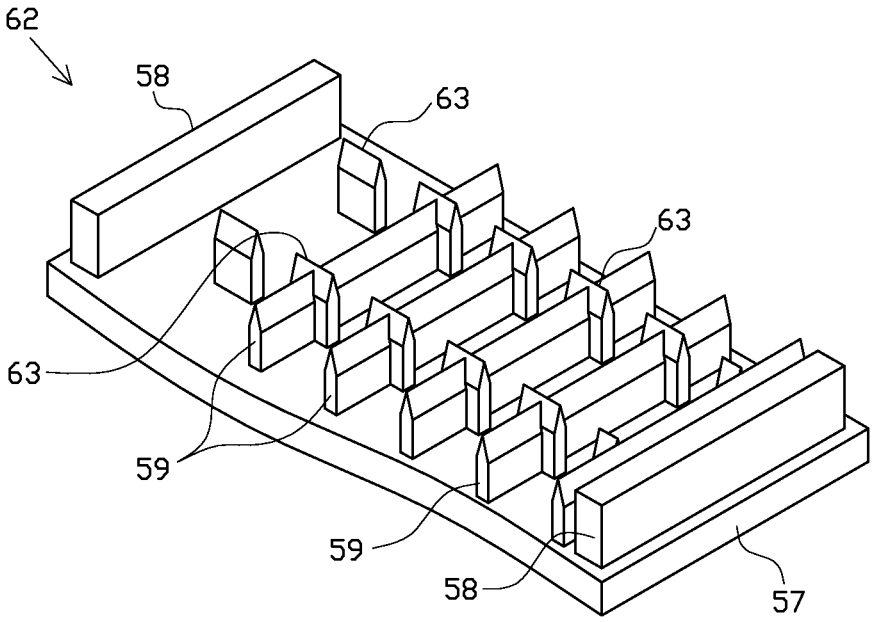
FIG. 17 is a perspective diagram illustrating a slit/cut forming device according to one or more embodiments of the invention.

(d) According to the above embodiment, the slit forming device 33 and the cut forming device 34 are provided in series along the conveyance direction of the blister film 9. According to a modification, the slit forming device 33 and the cut forming device 34 may be integrated with each other. For example, as shown in FIG. 17, slit forming blades 59 and cut forming blades 63 may be arranged to intersect with each other to configure a slit/cut forming device 62 that integrates the slit forming device with the cut forming device. This configuration achieves downsizing of the blister packaging device 10, compared with a configuration that separately provides the slit forming device and the cut forming device.

Figure 18:
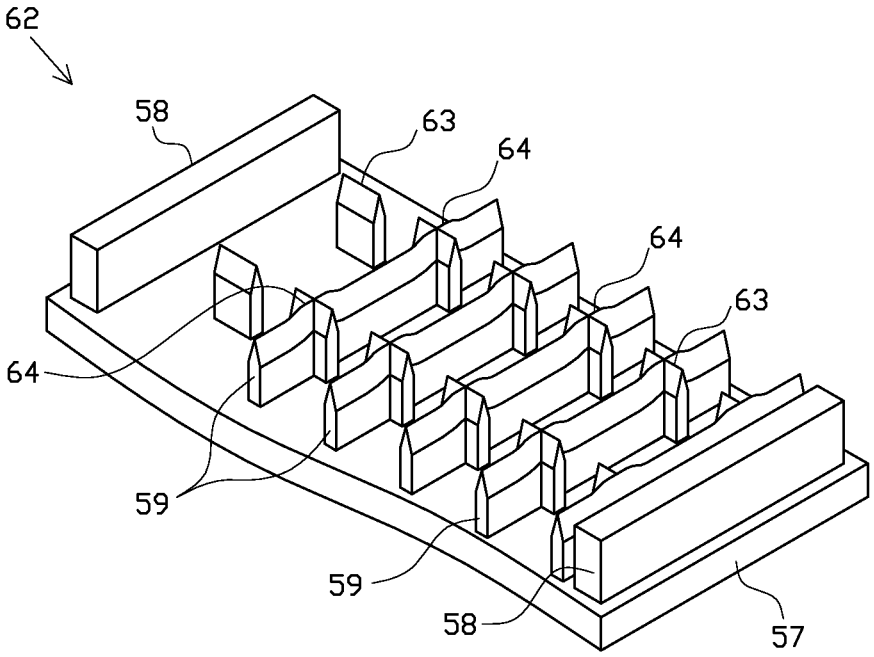
FIG. 18 is a perspective diagram illustrating a slit/cut forming device according to one or more embodiments of the invention.

In a configuration provided with intersect cuts 79, as shown in FIG. 18, intersect blades 64 may be provided integrally with slit forming blades 59 to form the intersect cuts 79.

(e) Information regarding a method of taking out the tablet 5 may be displayed on the blister sheet 1, although not being specifically mentioned in the above embodiment. For example, character strings, pictures or the like may be provided in a predetermined region (for example, the tag portion described above) of the blister sheet 1 to indicate that the tablet 5 is to be taken out by applying a torsional stress from the cut 8 toward the pocket 2 to break the cover film 4 and the like. This configuration allows a new user of the blister sheet 1 to check the information and readily understand the correct method of taking out the tablet. This furthermore enhances the convenience. This also more effectively prevents potential troubles (for example, damage of the tablet 5) due to an inappropriate method of taking out the tablet (for example, pressing the pocket 2).

Information indicating that the pocket 2 is not to be pressed may be displayed, in addition to the above information, on the blister sheet 1. This configuration furthermore effectively prevents potential troubles due to pressing the pocket 2 (for example, damage of the tablet 5).

These pieces of information may be provided by, for example, the stamping device 35 or may be provided by, in another example, a predetermined printing device.

(f) According to the above embodiment, the blister sheet 1 is provided with the cutting slits 7. Cutting perforations that are perforated through-out lines may be provided in place of the cutting slits 7. In a configuration with the cutting perforations, the blister packaging machine 10 may be provided with a perforation forming device as the separation forming device to form cutting perforations. The perforation forming device may be configured, for example, by providing perforation forming blades (for example, jagged blades) to form cutting perforations that pass through the blister film 9, in place of the slit forming blades 59 of the slit forming device 33.

(g) The content is the tablet 5 according to the above embodiment but may be a capsule (for example, a medical product or a nutrition product).

(h) The materials of the container film 3 and the cover film 4 are not limited to those described in the above embodiment but may be changed appropriately.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 . . . blister sheet, 2 . . . pocket, 3 . . . container film, 4 . . . cover film, 5 . . . tablet (content), 6 . . . pair piece (sheet piece), 7 . . . cutting slit, 8 . . . cut, 9 . . . blister film, 10 . . . blister packaging machine, 15 . . . heating device (pocket forming device), 16 . . . pocket forming device (pocket forming device), 20 . . . film-receiving roll (mounting device), 21 . . . tablet filling device (filling device), 25 . . . heating roll (mounting device), 33 . . . slit forming device (separation forming device), 34 . . . cut forming device (cut forming device), 38 . . . sheet punching device (punching device), 79 . . . intersect cut

What is claimed is:

1. A blister sheet comprising:

a container film comprising a plurality of pockets that receives therein a content comprising at least one of a tablet and a capsule; and a cover film mounted to the container film to close the pockets, wherein the container film and the cover film are respectively made of synthetic resins, the cover film is thinner than the container film, at least one pair of cuts formed for each of the pockets passes through the container film and the cover film and extends to each of the pockets such that each of the pockets is placed between at least one pair of cuts, the container film and the cover film are broken from the one pair of cuts toward each of the pockets by applying a torsional stress from the one pair of cuts toward each of the pockets, at least the cover film is broken at a position corresponding to each of the pockets, and the content is taken out from a portion of breakage of the cover film, a cutting slit or a cutting perforation is formed in at least the container film to allow for separation of the blister sheet into sheet pieces, each having a predetermined number of the pockets, the cutting slit or the cutting perforation is extended to intersect with at least one of the cuts, and the cutting slit or the cutting perforation comprises a penetrating part that:

extends across a point at which the cutting slit or the cutting perforation intersects with at least one of the cuts, and penetrates through the container film and the cover film.

2. The blister sheet according to claim 1, wherein multiple pairs of the cuts are provided for each of the pockets.

3. The blister sheet according to claim 1, wherein the at least one pair of cuts is arranged to be approximately aligned with each other.

4. The blister sheet according to claim 2, wherein the at least one pair of cuts is arranged to be approximately aligned with each other.

5. The blister sheet according to claim 1, wherein information regarding a method of taking out the content by applying the torsional stress from the cuts toward each of the pockets is displayed.

6. The blister sheet according to claim 2, wherein information regarding a method of taking out the content by applying the torsional stress from the cuts toward each of the pockets is displayed.

7. The blister sheet according to claim 3, wherein information regarding a method of taking out the content by applying the torsional stress from the cuts toward each of the pockets is displayed.

8. The blister sheet according to claim 4, wherein information regarding a method of taking out the content by applying the torsional stress from the cuts toward each of the pockets is displayed.

9. The blister sheet according to claim 1, wherein a length of the penetrating part is smaller than a length of each of the pockets in a direction along the cutting slit or the cutting perforation.

10. A blister packaging machine comprising:

a pocket forming device that forms a plurality of pockets in a container film made of a synthetic resin;

a filling device that fills a content comprising at least one of a tablet and a capsule in each of the pockets;

a mounting device that mounts a cover film to the container film with the content filled in each of the pockets so as to close the pockets and produce a blister film, wherein the cover film is thinner than the container film and is made of a synthetic resin;

a punching device that punches the blister film in a sheet unit;

a cut forming device that forms at least one pair of cuts for each of the pockets in the blister film, wherein the at least one pair of cuts passes through the container film and the cover film and extends to each of the pockets such that each of the pockets is placed between the one pair of cuts; and a separation forming device that forms a cutting slit or a cutting perforation in at least the container film, wherein the cutting slit or the cutting perforation extends in a direction perpendicular to at least one of the cuts and allows the blister sheet to separate into sheet pieces, each having a predetermined number of the pockets, wherein the separation forming device forms the cutting slit or the cutting perforation such that the cutting slit or the cutting perforation comprises a penetrating part that:

extends across a point at which the cutting slit or the cutting perforation intersects with at least one of the cuts, and penetrates through the container film and the cover film.

11. The blister packaging machine according to claim 10, wherein the cut forming device is integrated with the separation forming device.

12. A blister packaging method comprising:

forming a plurality of pockets in a container film made of a synthetic resin;

filling a content that is at least one of a tablet and a capsule in each of the pockets;

mounting a cover film to the container film with the content filled in each of the pockets so as to close the pockets and produce a blister film, wherein the cover film is thinner than the container film and is made of a synthetic resin;

punching the blister film in a sheet unit;

forming at least one pair of cuts for each of the pockets in the blister film, wherein the one pair of cuts passes through the container film and the cover film and extends to each of the pockets such that each of the pockets is placed between at least one pair of cuts; and forming a cutting slit or a cutting perforation in the container film, wherein the cutting slit or the cutting perforation extends in a direction perpendicular to at least one of the cuts and allows the blister sheet separate into sheet pieces, each having a predetermined number of the pockets, wherein in the forming of the cutting slit or the cutting perforation, the cutting slit or the cutting perforation is formed to comprise a penetrating part that:

extends across a point at which the cutting slit or the cutting perforation intersects with at least one of the cuts, and penetrates through the container film and the cover film.

* * * * *